United States Patent [19]

Nagata et al.

[11] Patent Number: 4,711,339

[45] Date of Patent: Dec. 8, 1987

[54] CIGARETTE STACKING METHOD AND APPARATUS

[75] Inventors: Tomizou Nagata; Yoshiyuki Mutoh; Kazutaka Kobayashi, all of Tokyo, Japan

[73] Assignee: Japan Tobacco, Inc., Japan

[21] Appl. No.: 922,788

[22] Filed: Oct. 23, 1986

Related U.S. Application Data

[63] Continuation of Ser. No. 647,903, Sep. 6, 1984, abandoned.

[30] Foreign Application Priority Data

Sep. 13, 1983 [JP] Japan ..... 58-167583

[51] Int. Cl.[4] ..... B65G 47/26

[52] U.S. Cl. ..... 198/419; 198/420; 414/63; 53/150

[58] Field of Search ..... 198/419, 420; 53/148–150, 152; 131/282, 283; 414/54, 59, 63

[56] References Cited

U.S. PATENT DOCUMENTS

| | | | |
|---|---|---|---|
| 3,603,445 | 9/1971 | Zausch et al. | 198/419 |
| 4,364,464 | 12/1982 | Manservisi et al. | 198/419 |
| 4,471,866 | 9/1984 | Erdmann et al. | 198/419 |
| 4,592,374 | 6/1986 | Focke et al. | 131/283 |
| 4,614,263 | 9/1986 | Nagata et al. | 198/420 |

FOREIGN PATENT DOCUMENTS

| | | | |
|---|---|---|---|
| 2327916 | 12/1973 | Fed. Rep. of Germany | 53/151 |
| 47-8600 | 3/1972 | Japan . | |
| 1168447 | 10/1969 | United Kingdom | 53/151 |
| 2034577 | 6/1980 | United Kingdom | 131/282 |

*Primary Examiner*—Joseph E. Valenza

*Attorney, Agent, or Firm*—Lowe, Price, LeBlanc, Becker & Shur

[57] ABSTRACT

A cigarette stacking method is disclosed. It uses a stacking drum and a plurality of arranging drums near to its outer periphery, establishes different positions in the axial direction for cigarette pieces arranged by the arranging drums, stacks cirgarette groups in several layers in such a manner as to extend the end portions of the cigarette pieces successively in the axial direction on the stacking drum, and absorbs and maintains the cigarette pieces of each layer. A cigarette stacking apparatus is also disclosed.

6 Claims, 14 Drawing Figures

CIGARETTE STACKING METHOD AND APPARATUS

This application is a continuation of application Ser. No. 647,903, filed Sept. 6, 1984, now abandoned.

BACKGROUND OF THE INVENTION

The present invention relates to a cigarette stacking method and apparatus thereof, which are to be used in one process prior to the process for enclosing cigarette pieces in a package.

As known, cigarette pieces are enclosed in a package in the piled-up state to form honeycomb patterns, for example, 7 pieces, 6 pieces and 7 pieces. It is of a vital importance for a cigarette packing to pile up the cigarette pieces without incurring much impact thereto and deliver the piled-up cigarettes to the succeeding process while maintaining the piled-up state as it is.

In the prior art, as disclosed in Japanese Patent Application Post-Examination Publication No. 47(1972)-8600 and Japanese Patent Application Early Publication No. 57(1982)-198082, when the top, intermediate and bottom cigarette groups are to be received on the stacking drum, the bottom cigarette groups which were received in advance cannot be maintained sufficiently. Therefore, troubles are apt to occur when the top cigarette groups are received which results in low productivity. Moreover, when the cigarette groups piled up in three layers, i.e., top, intermediate and bottom easily collapse, since the maintenance of cigarette pieces in each layer is not complete. This often creates troubles in the following process.

Furthermore, when the cigarette pieces in each layer are received on the stacking drum, the delivering and receiving speed are not in accord. Therefore, a good balanced piling up of cigarette pieces cannot be obtained, thus endangering the stability of the stacked cigarette pieces.

SUMMARY OF THE INVENTION

It is therefore a general object of the present invention to provide a method and apparatus for arranging cigarette pieces,wherein upper and lower cigarette groups are stacked or piled up in such a manner as to be extended the end portions of the cigarette pieces successively in the axial direction on the stacking drum, and such cigarette groups are absorbed by suction plates so that a stable piling up state of cigarette pieces can be obtained.

Another object of the invention is to provide a method and apparatus for arranging cigarette pieces, wherein the cigarette groups piled up in three layers will not easily collapse.

In order to achieve the above objects and others, there is essentially provided a cigarette stacking method comprising using a stacking drum as well as a plurality of arranging drums provided in the close vicinity of the outer periphery thereof, establishing different positions in the axial direction for cigarette pieces arranged by said plurality of arranging drums, stacking cigarette groups in several layers in such a manner as to extend the end portions of the cigarette pieces successively in the axial direction on the stacking drum, and absorbing and maintaining the cigarette pieces in each layer. There is also essentially provided a cigarette stacking apparatus comprising a stacking drum including stacking portions, and a plurality of cigarette receiving suction plates including a plurality of arcuate supporting grooves and suction holes opened up in said arcuate supporting grooves, said cigarette receiving suction plates being movably provided with respect to each other in the radial direction of the stacking drum, the arcuate supporting grooves adjacent with respect to each other of said receiving suction plates being arranged in a half way slided manner in the circumferential direction.

DETAILED DESCRIPTION OF THE EMBODIMENT

Figure 1:
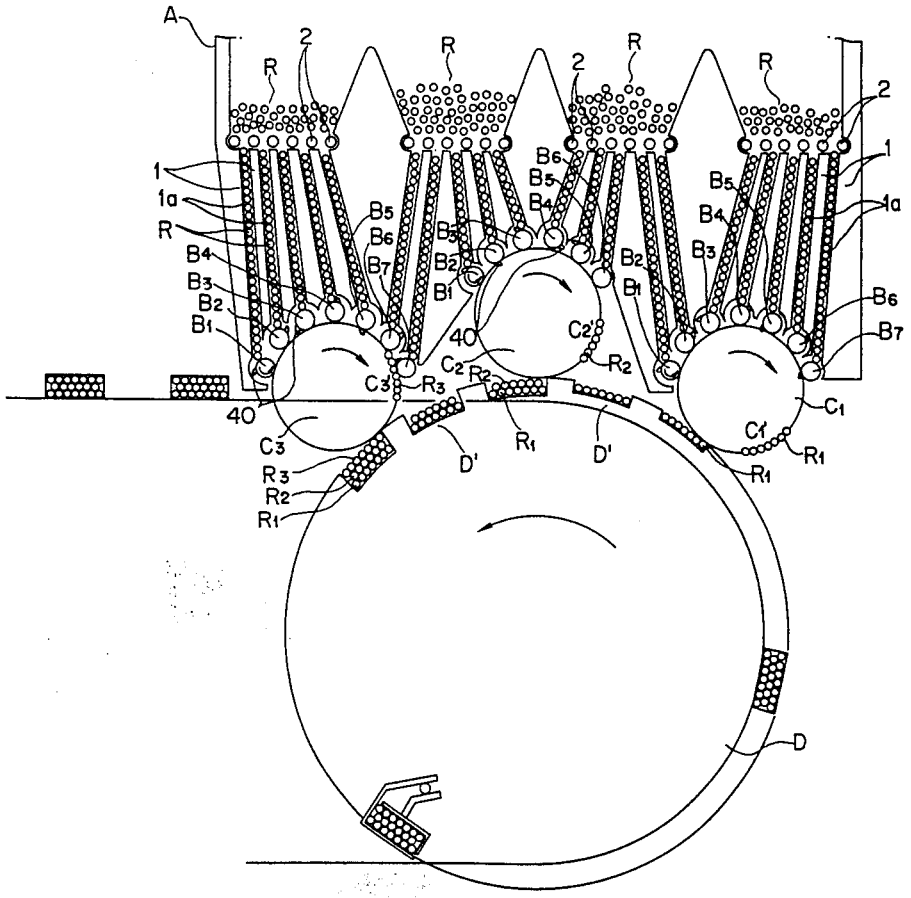
FIG. 1 is a schematic view showing the overall cigarette stacking apparatus to which the present invention is applied.
Figure 2:
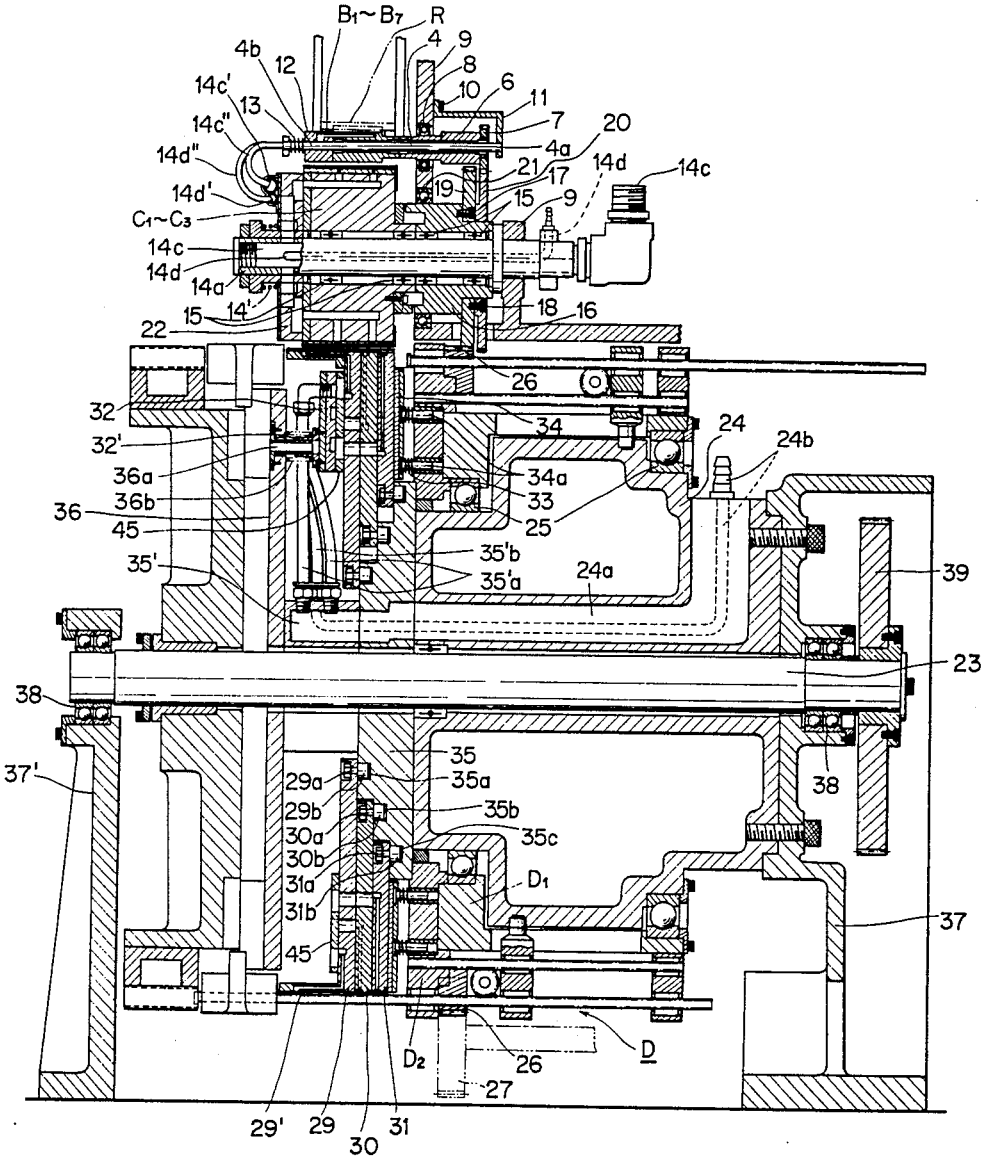
FIG. 2 is a sectional view showing the concrete constitution of the above.
Figure 4:
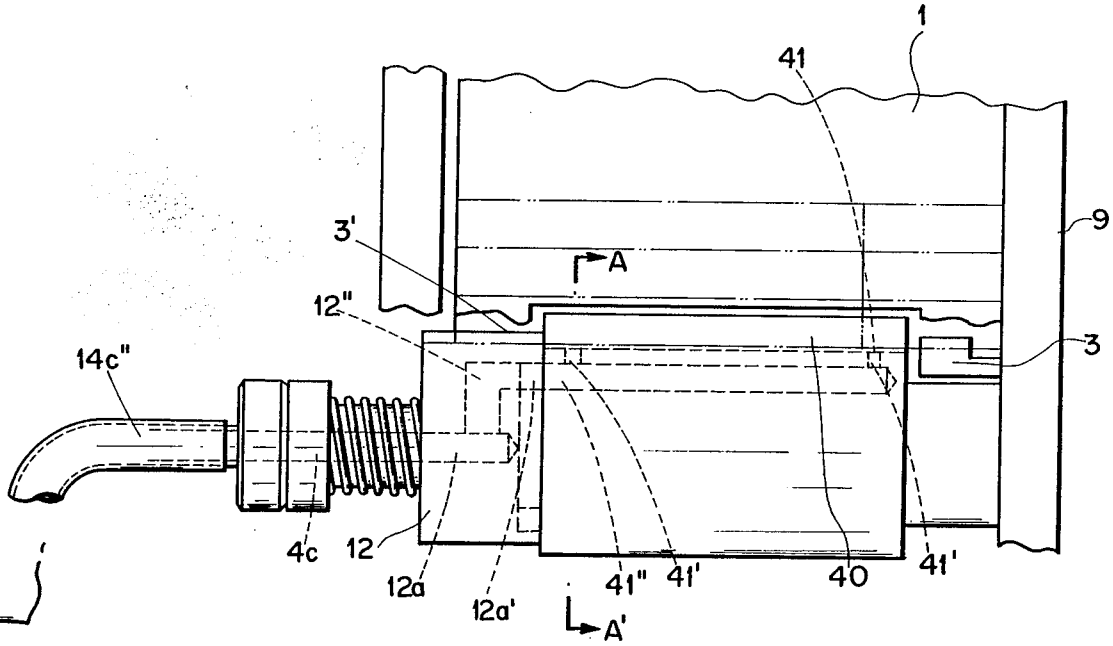
FIG. 4 is a side view showing the cigarette receiving roller portion.
Figure 3:
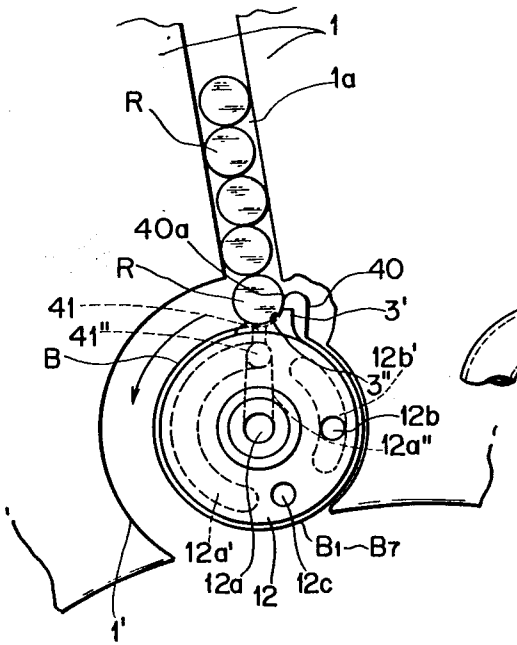
FIG. 3 is a front view showing a cigarette receiving roller portion.
Figure 5:
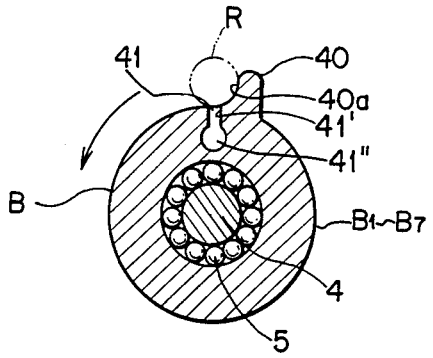
FIG. 5 is a sectional view of the cigarette receiving roller taken on line A—A' of FIG. 4.
Figure 9:
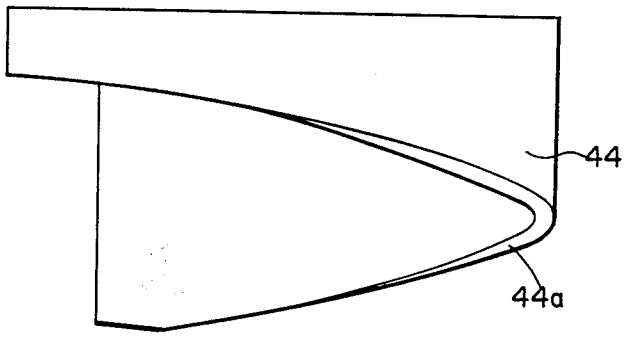
FIG. 9 is a plan view showing a cigarette transferring guide.
Figure 10:
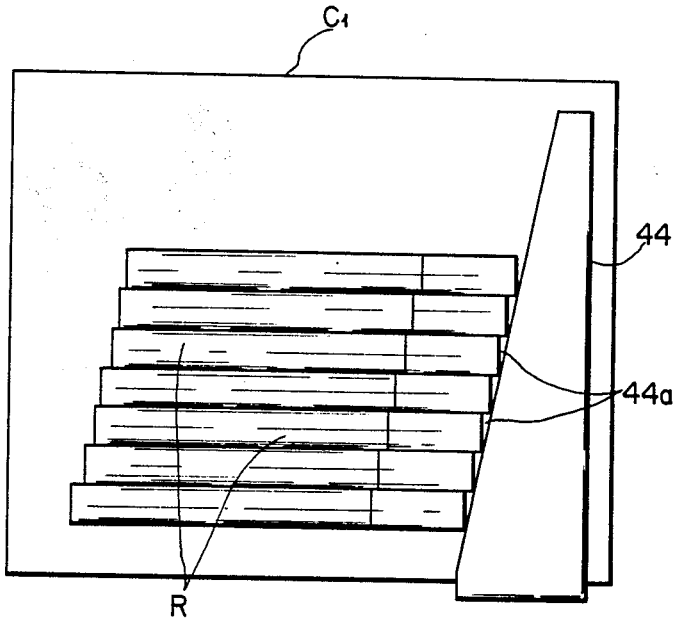
FIG. 10 is a schematic view showing the cigarette transferring guide when in use.
Figure 6:
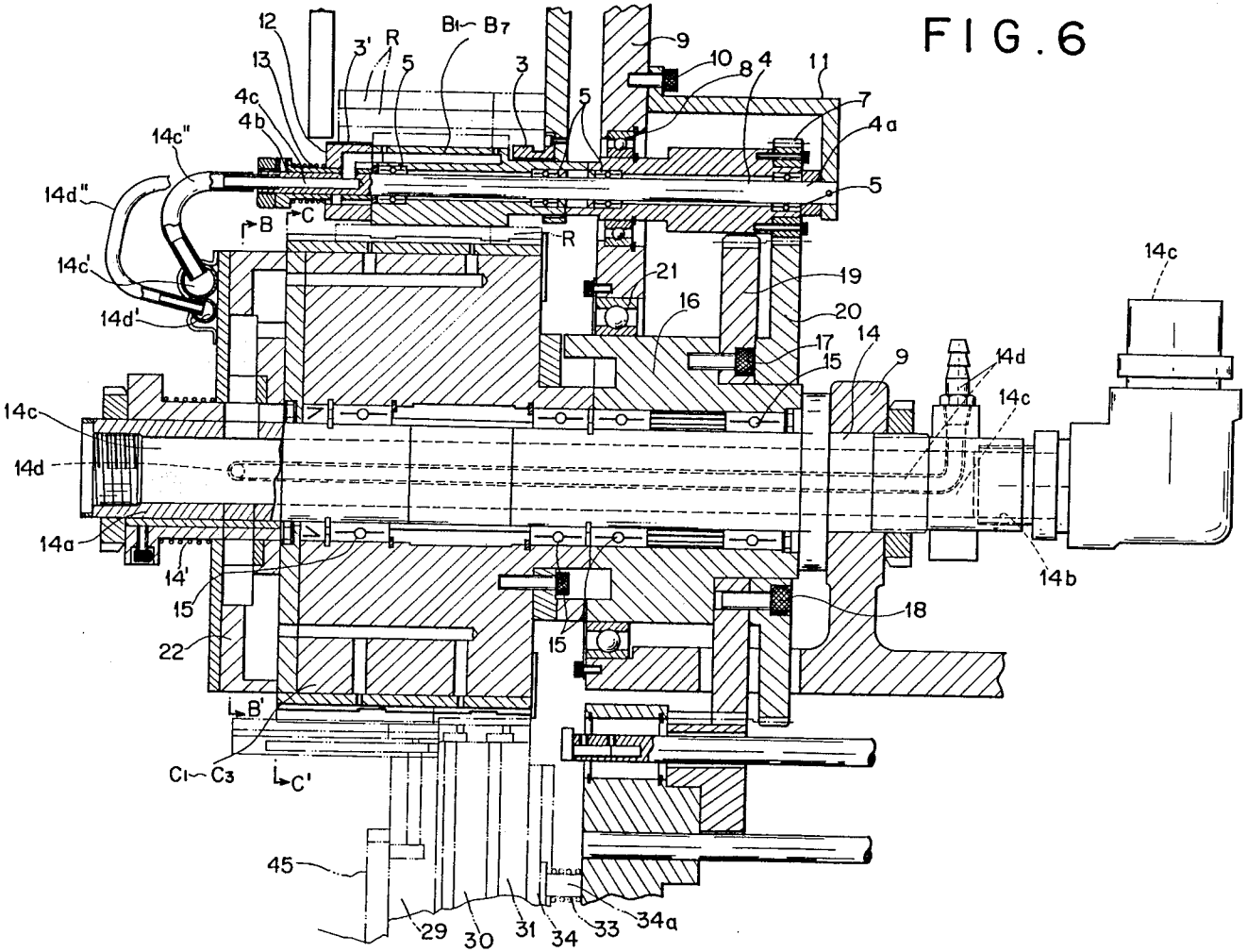
FIG. 6 is an enlarged sectional view of the receiving roller and arranging roller.
Figure 7:
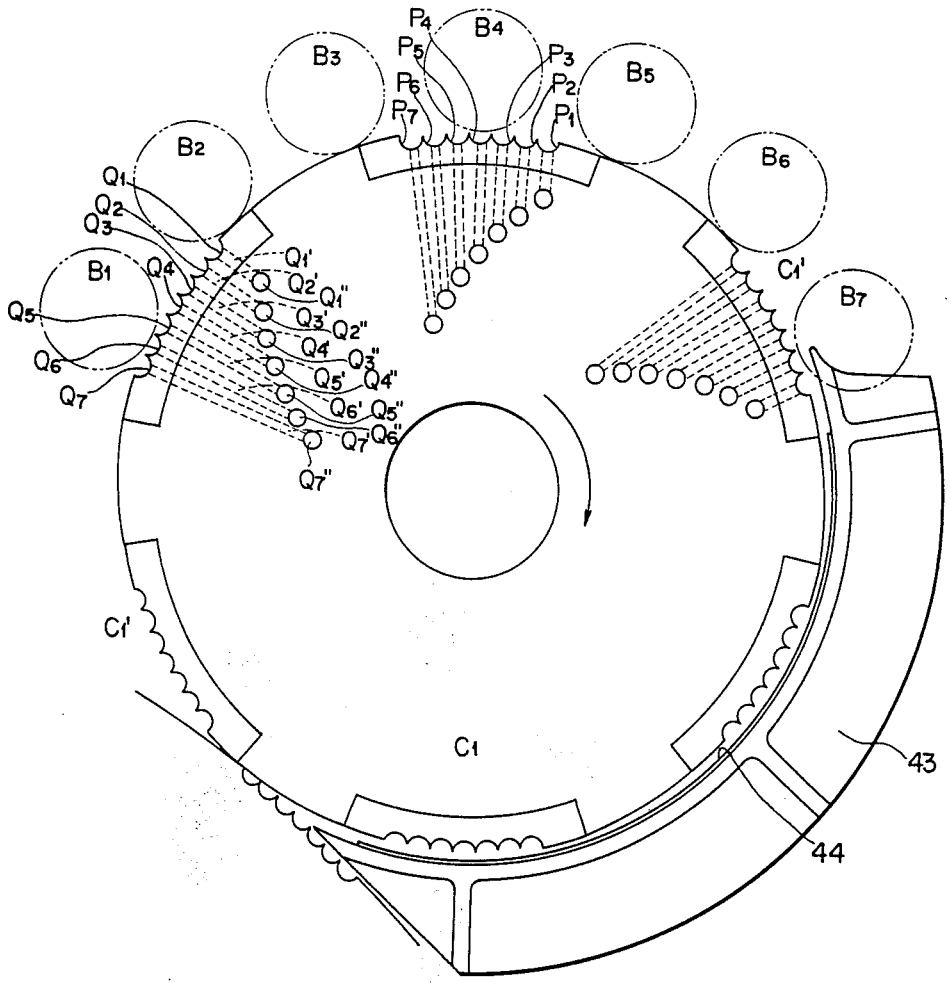
FIG. 7 is a sectional view taken on line C—C' of FIG. 6.
Figure 8:
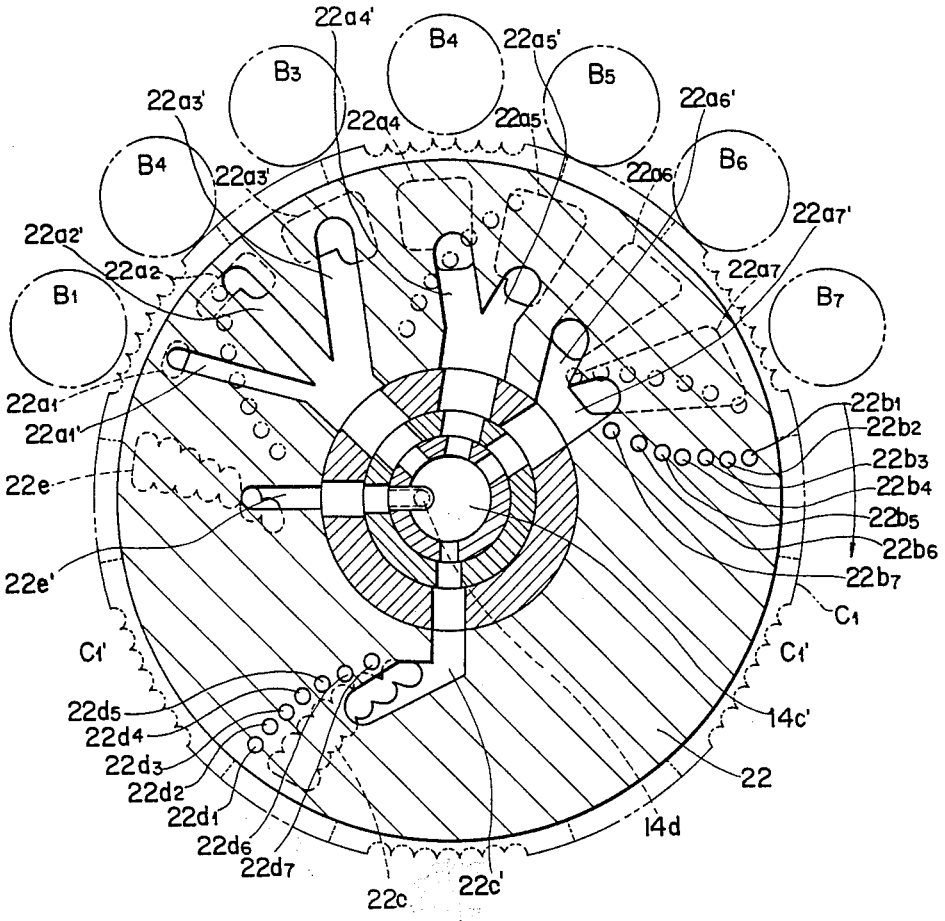
FIG. 8 is a sectional view of an air controlling ring taken on line B—B' of FIG. 6.
Figure 11:
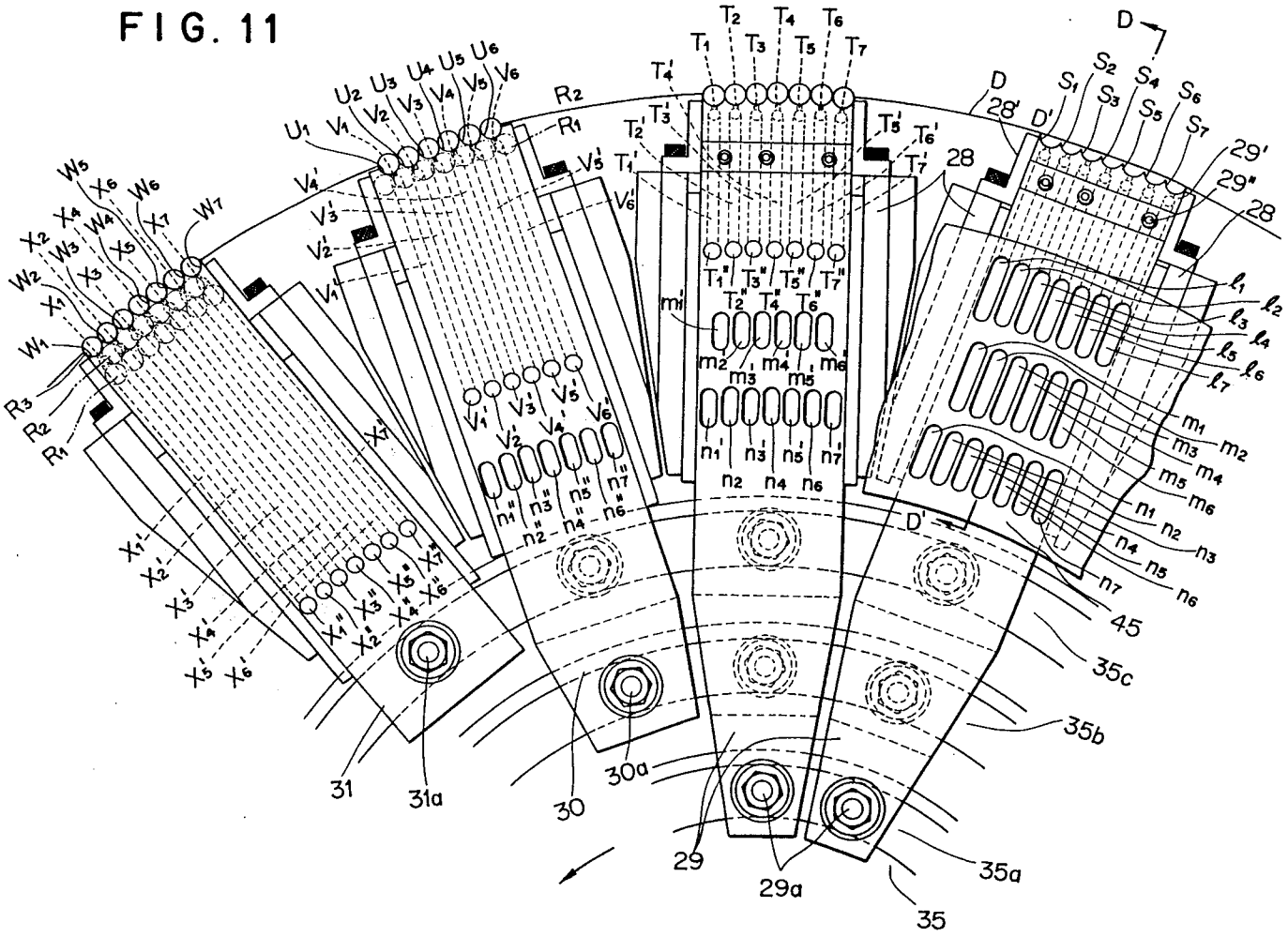
FIG. 11 is a front view of a plurality of receiving suction plates in the stacking drum, showing an air passage regulating plate from the right side to the left side in order as well as a bottom row receiving suction plate in its position preparing to receive cigarettes, a bottom row receiving suction plate in its state ready to receive cigarette pieces, an intermediate row receiving suction plate in its state ready to receive cigarette pieces, and a top row receiving suction plate in its state ready to receive cigarette pieces.
Figure 12:
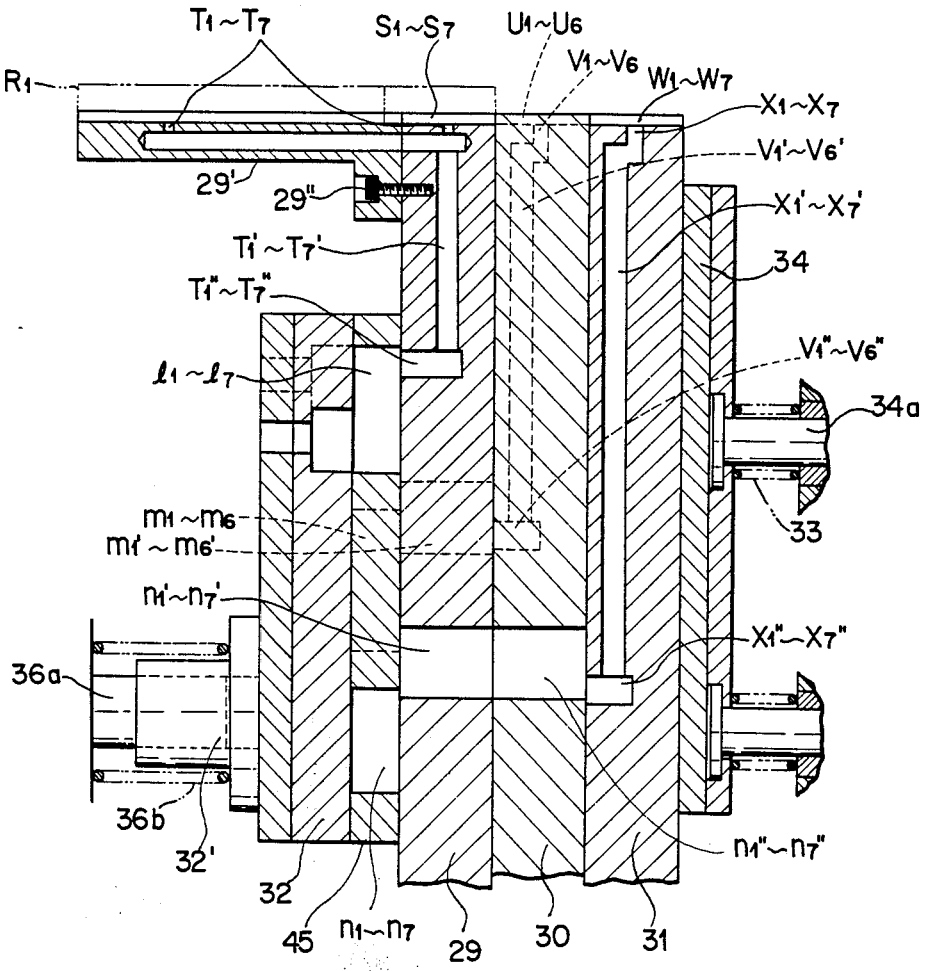
FIG. 12 is a sectional view of the bottom row cigarette receiving position in the stacking portion taken on line D—D' of FIG. 11.
Figure 13:
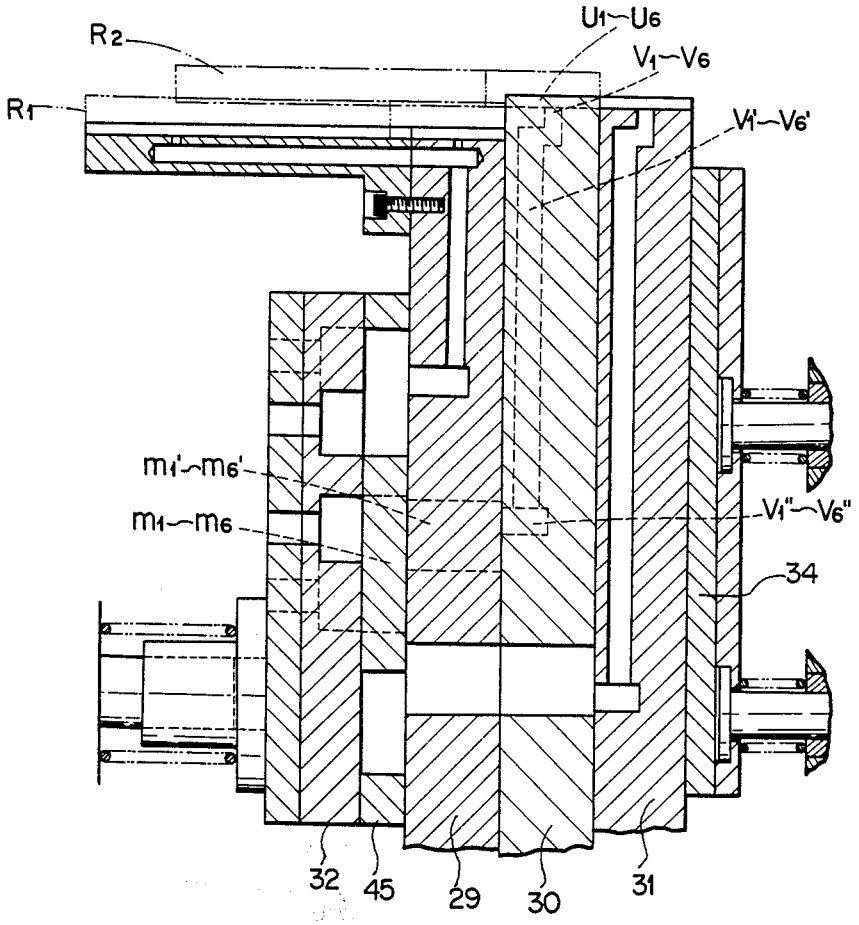
FIG. 13 is a sectional view of the above in its intermediate row cigarette receiving position taken on line D—D' of FIG. 11.
Figure 14:
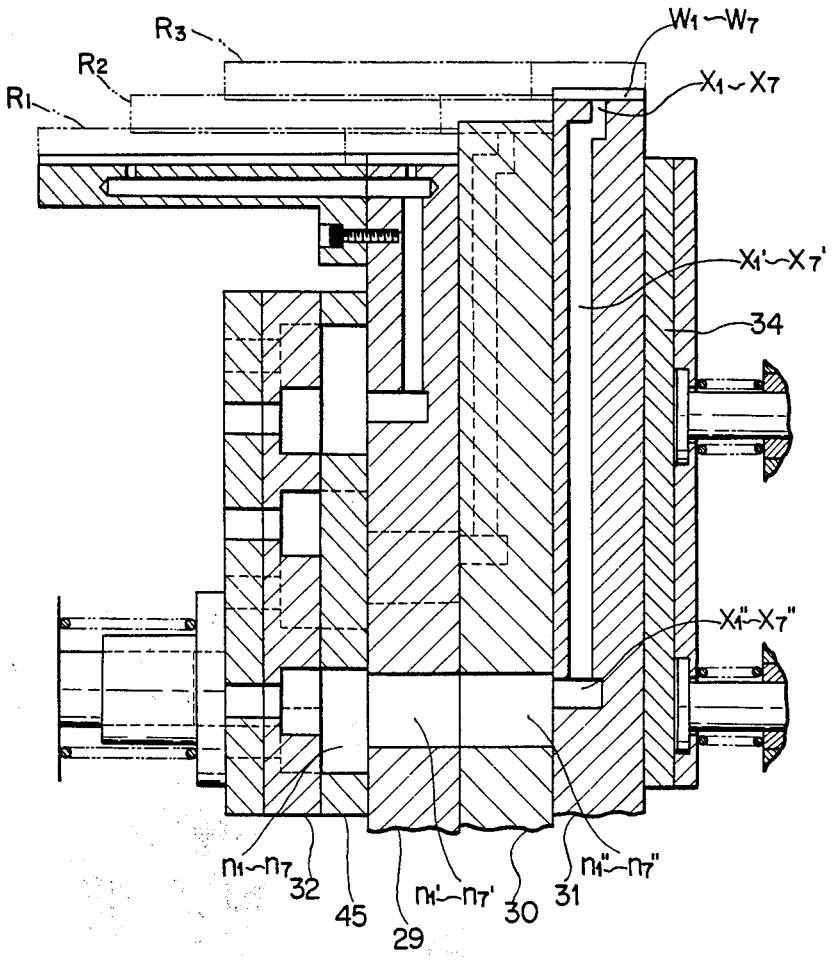
FIG. 14 is a sectional view of the above in its top row cigarette receiving position on line D—D' of FIG. 11.

Preferred embodiments of the present invention will be described hereunder with reference to the accompanying drawings.

A denotes a cigarette hopper; $B_1$ through $B_7$ denote receiving rollers each for receiving a piece of cigarette; $C_1$, $C_2$ and $C_3$ denote cigarette arranging drums; and D denotes a cigarette stacking drum. In the close vicinity of the stacking drum D at its upper outer periphery are provided an arranging drum $C_1$ for 7 pieces of cigarette, an arranging drum $C_2$ for 6 pieces of cigarette, and an arranging drum $C_3$ for 7 pieces of cigarette. In the close vicinity of each of said arranging drums $C_1$, $C_2$ and $C_3$ at its upper outer periphery, are provided 7 pieces or 6 pieces of cigarette receiving rollers $B_1$ through $B_7$, $B_1$ through $B_6$ corresponding to the number of cigarettes to be arranged. From the lower portion of the hopper A, partition panels 1 are provided for forming cigarette dropping passages 1*a* reaching to 20 pieces in total of the receiving rollers $B_1$ through $B_7$, $B_1$ through $B_6$, $B_1$ through $B_7$ on each of the arranging rollers $C_1$, $C_2$ and $C_3$. Agitator rollers 2 are rotatably provided at the upper ends of said partition panels 1 in the hopper A in order to send cigarette pieces into the passages 1*a* smoothly.

The respective rollers $B_1$ through $B_7$, $B_1$ through $B_6$ and $B_1$ through $B_7$ are rotated counter-clockwise to send 7 pieces or 6 pieces of cigarette into the arranging drums $C_1$, $C_2$, $C_3$ rotating clockwise in such a manner as to accord the sending and receiving speed with respect to each other, so that the cigarette pieces are arranged in an intimately contacted state with respect to each other. The arranging drums $C_1$ and $C_3$ include 6 pieces of arranging portion equally divided by 6, while the arranging drum $C_2$ includes 5 pieces of arranging portion equally divided by 5. The arranging drum $C_1$ supplies 7 pieces of cigarette group $R_1$ in the bottom row to respective stacking portions D' provided at equally divided positions by 18 of a stacking drum D, said stacking drum D being rotated counter-clockwise. Likewise, the arranging drums $C_2$, $C_3$ supply cigarette groups $R_2$, $R_3$, i.e., 6 pieces of the intermediate row and 7 pieces of the top row, to the respective stacking portions D'. In the foregoing, the receiving rollers $B_1$ through $B_7$, arranging drums $C_1$, $C_2$, $C_3$ and the stacking drum D are constituted such that the peripheral speed at the rolling cores of the supporting cigarette pieces are all in accord with respect to each other.

The receiving roller B is rotatably mounted on a rigid shaft 4 through a bearing 5. The rigid shaft 4 is provided with a rotary transmitting member 6 likewise through the bearing 5, said rotary transmitting member 6 being engaged at its end with the receiving rollers $B_1$ through $B_7$. At the other end of said rotary transmitting member 6 is provided a gear 7. Said rotary transmitting member 6 is supported by a frame 9 through a bearing 8. Said frame 9 is fixed with a subframe 11 by a screw 10 and said subframe 11 is fixed with one end 4*a* of the rigid shaft 4. At the other end 4*b* of the rigid shaft 4 is slidably mounted in the axial, direction an air control ring 12 which is urgedly contacted to the outsides of the receiving rollers $B_1$ through $B_7$ by a coil spring 13.

The arranging drum C is rotatably mounted on the rigid shaft 14 through a bearing 15. Said rigid shaft 14 is provided with a rotary transmitting member 16 likewise through a bearing 15, said member 16 being engaged at its one end with the arranging drums $C_1$ through $C_3$. At the other end of said rotary transmitting member 16 are juxtaposed gears 19, 20 through screws 17, 18. The rotary member 16 is supported by the frame 9 through a bearing 21. This means that a part of the rigid shaft 14 is indirectly supported by the frame 9, and at the same time, the other portion of the rigid shaft 14 is directly supported by the frame 9. At one end 14*a* of the rigid shaft 14 is slidably provided an air control ring 22 which is urgedly contacted to a side face of the arranging drum C by a coil spring 14'. At the other end 14*b* of the rigid shaft 14 is opened up a vacuum suction passage 14*c* within which a pressurized air supply pipe 14*d* is provided. Said vacuum suction passage 14*c* and said pressurized air supply pipe 14*d* are communicated with the air control ring 22.

The stacking drum D is comprised of a cylindrical portion $D_1$ and an annular plate portion $D_2$, and is rotatably provided with respect to an annular rigid member 24 through a bearing 25. At the side portion of the stacking drum D is provided a large gear 26 which meshes with an input gear 27 for rotating the stacking drum D, when the power is transmitted. The arranging drum C is rotated by means of the engagement of the large gear 26 and the gear 19. Furthermore, the gear 20 juxtaposed with the gear 19 is meshed with the gear 7 to transmit the power to the roller B.

On one side of the stacking drum D, a pair of L-shaped slide guide members 28 are fixedly secured to the annular plate portion $D_2$ at its equally divided position by 18 in such a manner as to form an accommodation pocket toward the radial direction from the center thereof. Within said slide guide member 28, there are provided a bottom row cigarette receiving suction plate 29, an intermediate row cigarette receiving suction plate 30 and a top row cigarette receiving suction plate 31 to which cigarettes are supplied from the arranging drum C, in such a manner as to be overlapped in the axial direction and at the same time, independently slidable with respect to each other in the radial direction. At the end of the outer periphery of the slide guide member 28 is fixed a supporting metal 28' to form a cigarette accommodation pocket with its both ends opened in the axial direction.

Said pair of slide guide members 28 are fixed with an air passage regulating plate 45 at the open ends thereof. Said air passage regulating plate 45 is slidingly contacted to the bottom row cigarette receiving suction plate 29 at its outer face. A presser plate 34 biased by a spring 33 and through a supporting shaft 34*a* is abutted against the top row cigarette receiving suction plate 31, so that the respective receiving suction plates 29, 30, 31 are pressed against the air passage regulating plate 45 while maintaining the intimate contact among the suction plates 29, 30, 31.

The respective receiving suction plates 29, 30, 31 are provided with cam followers 29*b*, 30*b*, 31*b* by pins 29*a*, 30*a*, 31*a*, said cam followers 29*b*, 30*b*, 31*b* being engaged with cam grooves 35*a*, 35*b*, 35*c* of a cam 35 fixed at one side of said annular rigid member 24. Within said annular rigid member 24, a vacuum suction passage 24*a* is provided and at the same time, a pressurized air supply pipe 24*b* is provided in a biased position with respect to the circumferential direction. Said vacuum suction passage 24*a* and said pressurized air supply pipe 24*b* are communicated with a fan-shaped air groove 35' fixed to the side of the cam 35 for supplying a vacuum suction as well as a pressurized air to the air control ring 32 through pipes 35'*a*, 35'*b*. The air control ring 32 is slidably mounted on a shaft 36*a* through a slide metal 32', and urgedly contacted to the air passage regulating plate 45 by a spring 36*b*, said shaft 36*a* being fixed by using a supporting plate 36 for a compression device in the succeeding process which is not directly related to the present invention.

The central rotary shaft 23 is supported by bearing stands 37 and 37' through a bearing 38, and inputted through a gear 39 mounted on one end thereof. Since the members rotated by the shaft 23 are not directly related to the present invention, description thereof will be eliminated.

At the lower portion of the cigarette dropping passage 1*a* defined by the partition panel 1, a pair of cigarette supporting members 3, 3' are provided on both sides of the receiving rollers $B_1$ through $B_7$ with respect to the axial direction thereof. The supporting member 3 is provided at the side portion of the frame 9, while the supporting member 3' is provided as an protruded portion on the outer periphery of the air control ring 12. The cigarette supporting members 3, 3' include an arcuate supporting plate 3'' opened up at the rotating direction side of the receiving rollers $B_1$ through $B_7$. The bottom portion of said arcuate supporting plate 3'' is formed slightly higher than the outer periphery B of the receiving rollers $B_1$ through $B_7$, thus leaving a space between the supporting cigarette piece R and the receiving rollers $B_1$ through $B_7$ in order to minimize the vibration of the cigarette piece R for avoiding the end face of the cigarette piece from getting damaged.

A cigarette transfer knob 40 including an arcuate abutting plane **40*a* is provided on the outer peripheral portion of the receiving rollers $B_1$ through $B_7$. A suction mouth 41 is opened up in front of the cigarette transfer knob 40 on the outer peripheral portion of the receiving rollers $B_1$ through $B_7$. Said suction mouth 41 is also opened up in the side face of the receiving rollers $B_1$ through $B_7$ through communication passages 41', 41''**.

The respective air control rings 12 slidingly contacted with the receiving rollers $B_1$ through $B_7$ are formed with a vacuum suction mouth **12*a*, a pressurized air supply mouth 12*b* and an atmospheric communication mouth 12*c*. The vacuum suction mouth 12*a* is connected to a common pipe 14*c'*provided on the outer side face of the air control ring 22 of the arranging drum C by a pipe 14*c''*** *through a communication hole 4c* of the rigid shaft. The pressurized air is connected to the pressurized air supply mouth **12*b* of the common air control ring 12 provided in the outer side face of the air control ring 22**.

The vacuum suction mouth **12*a* is communicated with arcuate groove 12*a'* defined in the range from the lower portion of the supporting member 3 to the vicinity of the arranging drum C through a communication passage 12''. The pressurized air supply mouth 12*b* is communicated with an arcuate groove 12*b'*** of a comparatively limited range.

Consequently, after dropping through the passage **1*a*, the cigarette pieces R are supported by the supporting members 3, 3' and sent out forwardly by the transmitting knob 40, while the receiving rollers $B_1$ through $B_7$ are rotated, and at the same time, the cigarette pieces R are transferred in the absorbed state by means of the vacuum suction mouth 41. At the end portion of the arcuate groove 12*a'*, the cigarette pieces R are relieved from the absorption by means of the atmospheric communication mouth 12*c* and sent into the arranging drums $C_1$, $C_2$ and $C_3$. The communication passages 41', 41'', leading to the vacuum suction mouth 41 are swept and cleaned by the pressurized air supplied from the pressurized air supply mouth 12*b*. A guide portion 1' is provided along the outer peripheral portion of the receiving rollers $B_1$ through $B_7$, said guide portion 1' being formed by extending the lower end of the partition panel 1**.

In the cigarette arranging drum $C_1$ , an arranging portion $C_1'$ is provided at one sixth position of the outer periphery of the drum. Said arranging portion $C_1'$ is provided with a continuous 7 pieces of arcuate supporting grooves $P_1$, $P_2$, $P_3$, $P_4$, $P_5$, $P_6$ and $P_7$ extending in the axial direction and intimately contacted with respect to each other in the circumferential direction of the arranging drum $C_1$. In the respective arcuate supplying grooves $P_1$ through $P_7$ are opened up vacuum suction mouths $Q_1$, $Q_2$, $Q_3$, $Q_4$, $Q_5$, $Q_6$ and $Q_7$ which are communicated with openings $Q_1''$, $Q_2''$, $Q_3''$, $Q_4''$, $Q_5''$, $Q_6''$ and $Q_7''$, respectively, on the side of the arranging drum $C_1$ through communication passages $Q_1'$, $Q_2'$, $Q_3'$, $Q_4'$, $Q_5'$, $Q_6'$ and $Q_7'$ which are increasingly longer toward the axial center.

The air control ring 22 for the arranging drum $C_1$ is provided in its upper half portion with vacuum suction grooves **22*a*$_1$, 22*a*$_2$, 22*a*$_3$, 22*a*$_4$, 22*a*$_5$, 22*a*$_6$ and 22*a*$_7$ which are divided in blocks and increasingly larger in dimension as if they are in accord with the above-mentioned openings $Q_1''$, $Q_2''$, $Q_4''$, $Q_5''$, $Q_6''$ and $Q_7''$. Said vacuum suction grooves 22*a*$_1$through 22*a*$_7$ are communicated with the central vacuum suction passage 14*c* through communication passages 22*a*$_1'$, 22*a*$_2'$, 22*a*$_3'$, 22*a*$_4'$, 22*a*$_5'$, 22*a*$_6'$ and 22*a*$_7'$**.

In the close vicinity of the last vacuum suction groove **22*a*$_7$ in the foregoing, 7 pieces of atmospheric communication mouths 22*b*$_1$, 22*b*$_2$, 22*b*$_3$, 22*b*$_4$, 22*b*$_5$, 22*b*$_6$ and 22*b*$_7$** are provided in order to break the vacuum.

In the lower portion of the air control ring 22, a continuous vacuum suction groove **22*c* of a limited small range is provided at the portion where the respective arranging portions $C_1'$ of the arranging drum $C_1$ are positioned close to the stacking drum D. Said vacuum suction groove 22*c* is also communicated with the central vacuum suction passage 14*c* through a communication passage 22*c'*. Atmospheric communication mouths 22*d*$_1$, 22*d*$_2$, 22*d*$_3$, 22*d*$_4$, 22*d*$_5$, 22*d*$_6$ and 22*d*$_7$ similar to the foregoing are provided in the close vicinity of the vacuum suction groove 22*c*. Furthermore, a continuous pressurized air supply mouth 22*e* is provided with a space therebetween and communicated with a pressurized air supply pipe 14*d* through a communication passage 22*e'***.

The receiving rollers $B_1$ through $B_7$ are provided in the close vicinity of the portion of the arranging drum $C_1$ corresponding to the 7 pieces of vacuum suction grooves **22*a*$_1$ through 22*a*$_7$ of the air control ring 22. A guide plate 43 is provided in the close vicinity of the outer peripheral portion of the arranging drum $C_1$ from the lower portion of the last receiving roller $B_7$ till the upper portion of the stacking drum D. Within said guide plate 43, a forced transferring guide 44** is provided in the axial direction.

When the arranging drum $C_1$ is rotated clockwise, the cigarette R is sent into the arcuate supporting groove $P_1$ of the respective arranging portions $C_1'$ from the included backward with respect to the rotary direction from the receiving roller $B_1$. At this moment, the vacuum suction mouth $Q_1$ is communicated with the vacuum suction groove **22*a*$_1$** so that the cigarette R is held by the arcuate supporting groove $P_1$ without fail. Nextly, as the arranging drum $C_1$ rotates, the cigarette piece R is sent into and held by the arcuate supporting groove $P_2$ in the intimately contacting state at the peripheral portion from the receiving roller $B_2$. Likewise, cigarette piece R is sent into the corresponding arcuate supporting grooves $P_3$, $P_4$, $P_5$, $P_6$ and $P_7$ from the receiving rollers $B_3$, $B_4$, $B_5$, $B_6$ and $B_7$, so that 7 pieces of cigarette groups $R_1$ are formed on the respective arranging portion $C_1'$ in the intimately contacting state with respect to each other.

After the vacuum suction is resolved, the cigarette groups $R_1$ are abutted against the guide 44 at the tapered driving plane **44*a* of the guide 44 and forced to transfer in the axial direction. Finally, the cigarette groups $R_1$ are transferred by 40 mm in the axial direction. When the guide 44 is brought to be disengagement with the guide plate 43, the cigarette groups $R_1$ are absorbed again in a moment by means of the vacuum suction groove 22c of the air control ring 22**. Then the suction is resolved by the atmospheric communication holes $22d_1$ through $22d_7$ and the cigarette groups $R_1$ are sent into the stacking portion D' of the stacking drum D.

In the arranging drum $C_2$, 6 pieces of cigarette groups $R_2$ intimately contacted each other are formed in the same manner as mentioned above. After forcedly transferred by 20 mm in the axial direction by a rigid plate (not shown), the cigarette groups $R_2$ are sent onto the afore-mentioned cigarette groups $R_1$ in the stacking portion D' of the stacking drum D and piled up on the bottom cigarette groups $R_1$ in the state biased in the axial direction by 20 mm with respect to the cigarette groups $R_1$.

In the arranging drum $C_3$, the cigarette groups $R_3$ are piled up upon the intermediate cigarette group $R_2$ as they are and in the state biased in the axial direction by 20 mm without transferring the cigarette groups $R_3$. The constitution of the arranging drums $C_2$, $C_3$ is basically the same as that of the arranging drum $C_1$.

In the respective stacking portions D' of the stacking drum D, there are provided and urgedly contacted with respect to each other the bottom cigarette receiving suction plate 29 for the 7 pieces of cigarette groups $R_1$, the intermediate cigarette receiving suction plate 30 for the 6 pieces of cigarette groups $R_2$, and the top cigarette receiving suction plate 31 for the 7 pieces of cigarette groups $R_3$.

On the outer end of the bottom cigarette receiving suction plate 29, cigarette receiving member 29' extending in the crossing direction with respect to the moving direction is secured by a screw 29''. From the bottom cigarette receiving suction plate 29 to the cigarette receiving member 29', arcuate supporting grooves $S_1$, $S_2$, $S_3$, $S_4$, $S_5$, $S_6$ and $S_7$ for the 7 pieces of cigarette are provided in the close vicinity thereto. Vacuum suction mouths $T_1$, $T_2$, $T_3$, $T_4$, $T_5$, $T_6$ and $T_7$ are opened up in said arcuate supporting grooves $S_1$ through $S_7$. Said vacuum suction mouths $T_1$ through $T_7$ are communicated with openings $T_1''$, $T_2''$, $T_3''$, $T_4''$, $T_5''$, $T_6''$ and $T_7''$ formed on the side of the bottom cigarette suction plate 29 through the communication passages $T_1'$, $T_2'$, $T_3'$, $T_4'$, $T_5'$, $T_6'$, and $T_7'$.

On the outer end of the intermediate cigarette receiving suction plate 30, arcuate supporting grooves $U_1$, $U_2$, $U_3$, $U_4$, $U_5$ and $U_6$ for the 6 pieces of cigarette are provided in the close vicinity thereto. Vacuum suction mouths $V_1$, $V_2$, $V_3$, $V_4$, $V_5$ and $V_6$ are opened up in said arcuate supporting grooves $U_1$ through $U_6$. Said vacuum suction mouths $V_1$ through $V_6$ are communicated with openings $V_1''$, $V_2''$, $V_3''$, $V_4''$, $V_5$ and $V_6''$ formed on the side of the intermediate cigarette receiving plate 30 through communication passages $V_1'$, $V_2'$, $V_3'$, $V_4'$, $V_5'$ and $V_6'$.

On the other end of the top cigarette receiving suction plate 31, arcuate supporting grooves $W_1$, $W_2$, $W_3$, $W_4$, $W_5$, $W_6$, $W_7$ for the 7 pieces of cigarette are provided in the close vicinity thereto. Vacuum suction mouths $X_1$, $X_2$, $X_3$, $X_4$, $X_5$, $X_6$ and $X_7$ are opened up in said arcuate supporting grooves $W_1$ through $W_7$. Said vacuum suction mouths $X_1$ through $X_7$ are communicated with openings $X_1$, $X_2$, $X_3$, $X_4$, $X_5$, $X_6$ and $X_7$ formed on the side of said top cigarette receiving suction plate 31 through communication passages $X_1'$, $X_2'$, $X_3'$, $X_4'$, $X_5'$, $X_6'$ and $X_7'$.

A passage regulating plate 45 positioned between the fan-shaped air control ring 32 and the bottom cigarette receiving suction plate 29 is provided with communication slots $l_1$, $l_2$, $l_3$, $l_4$, $l_5$, $l_6$ and $l_7$ for the openings $T_1''$ through $T_7''$ of the bottom cigarette receiving suction plate 29, communication slots $m_1$, $m_2$, $m_3$, $m_4$, $m_5$ and $m_6$ for the openings $V_1''$ through $V_6''$ of the intermediate cigarette receiving suction plate 30 and communication slots $n_1$, $n_2$, $n_3$, $n_4$, $n_5$, $n_6$ and $n_7$ for the openings $X_1''$ through $X_7''$ of the top cigarette receiving suction plate 31.

The bottom cigarette receiving suction plate 29 is formed of communication slots $m_1'$ through $m_6'$, $n_1'$ through $n_7'$ for the intermediate and the top cigarette receiving suction plates 30 and 31, while the intermediate cigarette receiving suction plate 30 is formed with communication slots $n_1''$ through $n_7''$ for the top cigarette receiving suction plate 31.

The respective communication slots $l_1$ through $l_7$, $m_1$ through $m_6$, $n_1$ through $n_7$, $m_1'$ through $m_6'$, $n_1'$ through $n_7'$ and $n_1''$ through $n_7''$ are formed in the range of slots which can correspond to the moving amount of the respective receiving suction plates 29, 30 and 31.

The air control ring 32 is formed of vacuum suction grooves and pressurized air supply mouths basically in the same manner as the afore-mentioned air control ring 22 of the arranging drums $C_1$, $C_2$ and $C_3$. Vacuum suction and pressurized air are sent from the air passage regulating plate 45 to the vacuum suction mouths $T_1$ through $T_7$, $V_1$ through $V_6$ and $X_1$ through $X_7$ of the respective receiving suction plates 29, 30 and 31 through the communication slots $l_1$ through $l_7$, $m_1$ through $m_6$ and $n_1$ through $n_7$.

The arcuate supporting grooves $U_1$ through $U_6$ in the intermediate cigarette receiving suction plate 30 are arranged in such a manner as to be a half way slided with respect to the arcuate supporting grooves $S_1$ through $S_7$ and $W_1$ through $W_7$ of the bottom and the top cigarette receiving suction plates 29 and 30 in the circumferential direction thereof.

With the above constitution, when the stacking drum D is rotated, the respective receiving suction plates 29, 30 and 31 approach to the arranging drums $C_1$, $C_2$ and $C_3$ at the outermost peripheral position in the stacking portion D'. The respective arcuate supporting grooves $S_1$ through $S_7$, $U_1$ through $U_6$ and $W_1$, through $W_7$ are brought to be in opposite relation with the arcuate supporting grooves $P_1$ through $P_7$ and $P_1$ through $P_6$ to form a cigarette accommodation space of a genuine circular configuration. The arcuate supporting grooves $S_1$ through $S_7$ for the bottom cigarette receiving suction plate 29 receive the 7 pieces of cigarette groups forced to move by 40 mm from the regular position from the arranging drum $C_1$ and the vacuum suction mouths $T_1$ through $T_7$ absorb and hold the 7 pieces of cigarette groups. After receiving and maintaining the cigarette groups $R_1$, the bottom cigarette receiving suction plate 29 is lowered by 7 mm and entered completely into the supporting metal 28' in order to prepare to receive the intermediate cigarette groups $R_2$.

Nextly, the stacking drum D piles up the 6 pieces of cigarette groups $R_2$ forced to move by 20 mm from the regular position from the arranging drum D upon the cigarette groups $R_1$ and at the same time the extended end portion by 20 mm is received by the arcuate supporting grooves $U_1$ through $U_6$ of the intermediate cigarette receiving suction plate 30 and absorbed and held by the vacuum suction mouths $V_1$ through $V_6$. In this state, the bottom and the intermediate cigarette receiving suction plates 29 and 30 are lowered together by 7 mm and entered completely into the supporting metal 28' in order to prepare to receive the top cigarette groups $R_3$.

Thereafter, the stacking drum D piles up the 7 pieces of cigarette groups $R_3$ upon the cigarette groups $R_2$ and at the same time the extended end portion by 20 mm is received by the arcuate supporting grooves $W_1$ through $W_7$ of the top cigarette receiving suction plate 31, and absorbed and held by the vacuum suction mouths $X_1$ through $X_7$. In this state, the respective cigarette receiving plates 29, 30 and 31 are lowered by 4 mm together with the stacking cigarette groups $R_1$, $R_2$ and $R_3$ and entered completely into the supporting metal 28'. Then, the succeeding compression process starts. In the foregoing, since the delivering and receiving peripheral speeds are same for all of the respective rows of cigarette groups, the cigarette groups can be piled up in an orderly manner in the regular position.

As apparent from the foregoing, according to the present invention, since the force of absorption can prevail on cigarette pieces in each layer, a stable piling up attitude of the cigarette pieces can be obtained. At the same time, the packing of cigarette pieces can be carried out at a high speed.

What is claimed is:

1. A cigarette stacking method using a stacking drum and a plurality of arranging drums provided in close proximity to the outer periphery thereof, comprising the steps of;

establishing different positions on said stacking drum in the axial direction thereof for cigarette pieces arranged by said plurality of arranging drums;

stacking cigarette grousp formed on said arranging drums in several layers on said stacking drum in such a manner as to extend the end portions of the cigarette pieces successively in the axial direction on the stacking drum so that each layer is staggered with respect to an adjacent layer; and absorbing and maintaining the cigarette pieces in each staggered layer by applying suction directly to the staggered end portions of each said cigarette in each said layer.

2. A cigarette stacking apparatus comprising:

a stacking drum (D) having a plurality of stacking portions (D') therearound and rotating in a predetermined direction, each stacking portion being formed with arcuate groove means;

a plurality of arranging drums (C) counter rotating relative to said stacking drum, said arranging drums being positioned opposite upwardly-facing ones of the stacking portions (D'), each arranging drum (C) having plural sets of arcuate grooves (P1 to P7 or P1 to P6) therearound, each arcuate groove being connected to a vacuum source;

cigarette supply means (B1 to B7) provided opposite upwardly-facing ones of said plural sets of arcuate grooves for supplying cigarettes such that said upwardly-facing sets of grooves receive said supplied cigarettes thereinto;

arcuate cigarette support members (43) provided concentrically outside the respective cigarette arranging drums (C) on a downstream side of said cigarette supply means to extend down to the proximity of a lower portion of the cigarette arranging drum (C):

guide means provided concentrically between the respective arranging drums and said arcuate support members for guiding plural sets of cigarettes received from said plurality of arranging drums into the respective stacking portions (D') of the stacking drum (D) in a manner axially staggered each set from the other in a predetermine direction;

said plural sets of arcuate grooves (P) in the respective arranging drum (C) being adapted to meet the arcuate groove means in the stacking portions (D') of the stacking drum (D) in synchronization with each other; and each stacking portion being provided with means for applying suction and support to said plural sets of cigarettes guided into said arcuate groove means of the stacking portion so that each set is axially staggered from the other in a predetermined direction.

3. A cigarette apparatus according to claim 2, wherein said plurality of arranging drums (C) includes first, second and third drums (C1, C2, and C3); said suction means including a first sucking plate (29); a second sucking plate (30) provided in a manner staggered axially from said first sucking plate and a third sucking plate (31) provided in a manner further staggered axially from said second sucking plate; said arcuate groove means including a first group of arcuate grooves formed in said first sucking plate to receive the first set of cigarettes from the first arranging drum; a second group of arcuate grooves formed in said second sucking plate to receive the second set of cigarettes from the second arranging drum and a third group of arcuate grooves formed in said third sucking plate to receive the third set of cigarettes, said first sucking plate (29) being adapted to descend axially inwardly by a predetermined amount after receiving the first set of cigarettes in the first grooves thereof, said second sucking plate (30) being adpated to descend axially inwardly by said predetermined amount together with said first sucking plate after receiving the second set of cigarettes in the second group of grooves thereof.

4. A cigarette stacking apparatus according to claim 3, wherein said stacking drum (D) has a disc-shaped cam (35) coaxially secured thereto; said disc-shaped cam (35) being formed in a flat surface thereof with first, second and third cam grooves to displace said first, second and third sucking plate in a radial direction, respectively.

5. A cigarette stacking apparatus according to claim 2, wherein said plural sets of arcuate grooves are subjected to sucking when positioned upstream of said arcuate cigarette support member and released from said sucking when positioned opposite said arcuate cigarette support member.

6. A cigarette stacking apparatus according to claim 3, wherein said plural sets of arcuate grooves are subjected again to sucking simultaneously when positioned immediately downstream of said arcuate cigarette support member and then released therefrom to deliver the cigarettes onto a relevant stacking portion.

* * * * *